US005239854A

United States Patent [19]

Hinson

[11] Patent Number: 5,239,854

[45] Date of Patent: Aug. 31, 1993

[54] PIVOTED BODY AND FIRE STRAIGHTENING RACK

[76] Inventor: Virgil H. Hinson, 206 Fairway Oak Dr., Brunswick, Ga. 31523

[21] Appl. No.: 888,482

[22] Filed: May 27, 1992

[51] Int. Cl.[5] ..... B21D 1/12

[52] U.S. Cl. ..... 72/457; 72/705; 254/88

[58] Field of Search ..... 72/457, 705; 187/8.41, 187/8.47; 254/94, 88

[56] References Cited

U.S. PATENT DOCUMENTS

| | | | |
|---|---|---|---|
| 808,208 | 12/1905 | Maxwell | 254/88 |
| 1,263,954 | 4/1918 | Sollender | 254/88 |
| 1,951,118 | 3/1934 | Ackerman | 187/8.41 |
| 3,583,203 | 6/1971 | Williams et al. . | |
| 4,313,335 | 2/1982 | Eck . | |
| 4,370,882 | 2/1983 | Labbe . | |
| 4,398,410 | 8/1983 | McWhorter et al. . | |
| 4,592,225 | 6/1986 | Eck . | |
| 4,643,015 | 2/1987 | Larson et al. . | |
| 4,660,405 | 4/1987 | Widegren et al. | 72/705 |
| 4,700,599 | 10/1987 | Hanni et al. . | |
| 4,791,802 | 12/1988 | Celette | 72/705 |
| 4,794,783 | 1/1989 | Eck . | |
| 4,932,236 | 6/1990 | Hinson . | |
| 5,027,639 | 7/1991 | Hinson . | |

*Primary Examiner*—Lowell A. Larson

*Attorney, Agent, or Firm*—Jacobson, Price, Holman & Stern

[57] ABSTRACT

A generally horizontal vehicle supporting rack is provided for support from a floor surface and includes depending support means intermediate its opposite ends for support from the support surface and mounting the rack for oscillatory movement between a horizontal position and an inclined position with one end of the rack swung downwardly toward the floor surface. The rack is yieldingly biased toward the horizontal position and includes fixed leg structure positively limiting movement of the rack from the inclined position to the horizontal position. Further, an elongated pull tower base having a pull tower pivotally mounted from one end thereof for angular displacement about a vertical axis is provided and includes opposite end portion floor engageable support wheels. The other end portion of the base is lengthwise displaceable laterally beneath one marginal portion of the platform and the base is rockable over the support wheels adjacent the one end thereof to elevate the other end portion for releasable locking in position relative to and beneath the rack marginal portion. Further, a vehicle chassis support stand is mounted from the inner end of an elongated base disposed transverse to and releasably secured to the rack marginal portion and the elongated base is pivotable about the outer end for swinging movement of the base inner end and the support stand toward the outer edge of the rack marginal portion.

8 Claims, 4 Drawing Sheets

PIVOTED BODY AND FIRE STRAIGHTENING RACK

BACKGROUND OF INVENTION

1. FIELD OF THE INVENTION

This invention relates to a elongated horizontal vehicle repair rack which is rockably mounted intermediate its opposite ends for movement between a horizontal elevated position above a support surface and a tilted position with one end of the rack resting upon the support surface. The other end of the rack includes abutment structure for engagement with the support surface to limit movement of the rack from the tilted position to the horizontal position and the rack is yieldingly biased toward the tilted position for movement of a wheeled vehicle along the support surface and upwardly onto the lowered end of the rack. Thereafter, the vehicle is movable along the rack toward the other end thereof until it reaches an over center position, at which time the rack will automatically pivot toward the horizontal position thereof in order that body and frame straightening work may be performed on the supported vehicle.

In addition, the rack includes a portable, wheeled pull tower structure which may be wheeled over the support surface into position operatively associated with selected points along the periphery of the rack and quickly locked in position relative thereto.

2. Description of Related Art

Various different forms of support racks including some of the general structural and operational features of the instant invention are disclosed in U.S. Pat. Nos.: 3,583,203, 4,313,335, 4,370,882, 4,398,410, 4,592,225, 4,643,015, 4,700,599, 4,794,783, 4,932,236 and 5,027,639. However, these previously known devices do not include the combination of structural features incorporated in the instant invention.

SUMMARY OF THE INVENTION

The pivoted body and frame straightening rack of the instant invention has been constructed to provide a rack up on to which a vehicle to be repaired may be towed or driven with the rack initially defining a ramp up on to which a selected vehicle may be rolled and which, upon movement of the vehicle along the ramp toward the upper end thereof, will automatically swing to a horizontal position enabling body and frame straightening operations to be carried out on the supported vehicle.

In addition, the rack includes portable, wheeled pull tower structure which, when the rack is horizontally disposed, may be moved into operative association with a selected peripheral portion of the rack and quickly locked into position with respect thereto, one or more pull tower structures being usable in conjunction with the rack.

The main object of this invention is to provide a very simple rack onto which a wheeled vehicle to be repaired may be driven or dragged with the rack automatically pivoting from an inclined ramp defining position to a horizontal working position in response to the vehicle to be worked on being moved onto the rack passed and "over the center" position thereon.

Another object of this invention is to provide a repair rack onto which damaged vehicles may be driven or towed even though the vehicles have been damaged to the extent that they have very low ground clearance.

Still another object of this invention is to provide a vehicle support rack in accordance with the preceding objects and which may be used to efficiently support both light and heavy vehicles.

A further object of this invention is to provide a rack which may be transformed from a ramp defining structure to a horizontal work position structure merely by proper placement of a vehicle thereon.

Yet another important object of this invention is to provide a vehicle body and frame straightening rack with which one or more pull towers may be quickly and easily operatively associated in predetermined positions spaced about the periphery of the rack.

A final object of this invention to be specifically enumerated herein is to provide a vehicle body and frame straightening rack in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
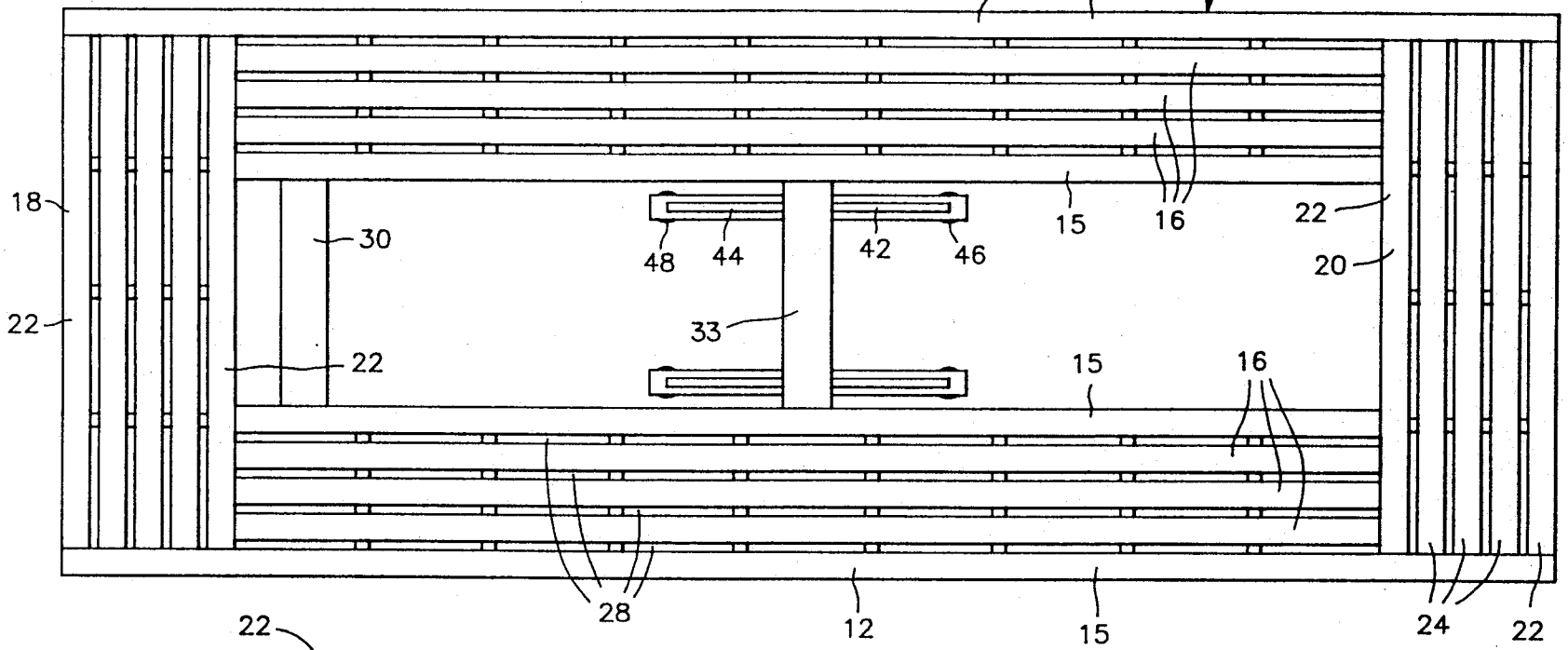
FIG. 1 is a top plan view of the rack of the instant invention.
Figure 7:
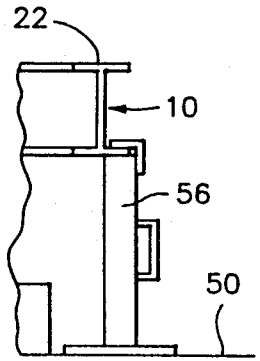
FIG. 7 is a fragmentary end elevational view of the rack illustrating the manner in which a prop stand may be used in conjunction therewith in order to maintain the rack in the horizontal position.

Referring now more specifically to the drawings the numeral 10 generally designates a rack 10 which is generally rectangular in horizontal plan shape and includes longitudinal opposite side treadways 12 and 14 each comprising a plurality of transversely relatively braced I-beam rails 15 and channel member rails 16 and a pair of transverse opposite end sections 18 and 20 each also comprising a pair of inner and outer I-beam rails 22 and a plurality of channel member rails 24 spaced apart laterally therebetween, the end sections 18 and 20 interconnecting corresponding ends of the treadways 12 and 14 and elongated slots 28 being defined between each pair of adjacent rails 15 and 16 for a purpose to be hereinafter more fully set forth.

The forward end of the rack 10 includes a transverse brace member 30 extending between the forward ends of the treadways 12 and 14 and the opposite ends of the brace member 30 are provided with opposite side depending support legs 32. Also, the approximate longitudinal center of the rack 10 includes a second transverse brace member 33 from whose opposite ends depending center legs 34 extend, a thick walled transverse cylindrical member 36 being secured to and extending between the lower ends of the legs 34.

Each leg 34 includes a rearwardly projecting high lever arm 38 and a forwardly projecting low lever arm 40, the arms 38 and 40 being braced relative to the upper ends of the legs 34 through the utilization of inclined braces 42 and 44.

Figure 5:
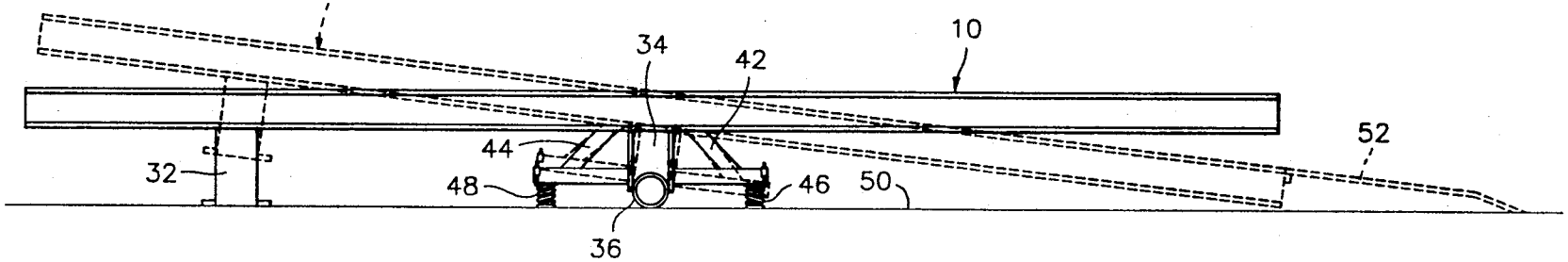
FIG. 5 is a side elevational view of the rack illustrated in horizontal position in solid lines and in an inclined position operatively associated with a loading ramp in phantom line.
Figure 6:
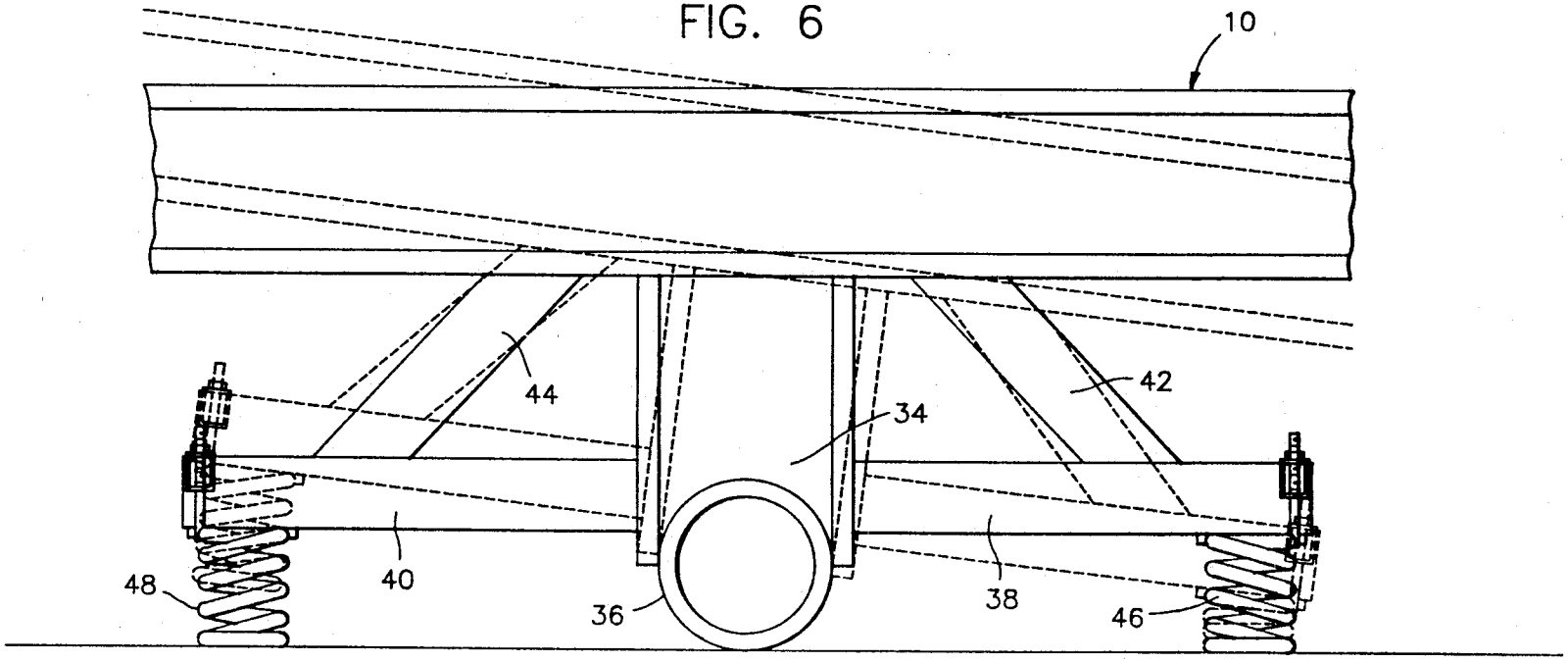
FIG. 6 is an enlarged fragmentary side elevational view of the center portion of the assembly illustrated in FIG. 5.

The upper ends of a pair of first compression springs 46 are removably secured to the underside portions of the rear ends of the high lever arms 38 and a similar pair of compression springs 48 are secured to the underside portions of the forward ends of the low lever arms 40, the springs 46 and 48 serving to yieldingly bias the rack 10 from the horizontal solid line position thereof illustrated in FIG. 5 to the rearwardly and downwardly inclined position illustrated by phantom lines in FIG. 5. The springs 48 cushion movement of the rack 10 to the horizontal position shown in solid lines in FIG. 5 and the springs 46 cushion movement of the rack 10 to the inclined position thereof shown in phantom lines in FIG. 5, the tilting of the legs 34 to the rear of the cylindrical member 36 serving to shift the center of gravity of the rack 10 to the rear of the point of contact of the cylindrical member 36 with the floor 50.

When the rack 10 is in its inclined position with the rear end thereof in contact with the floor 50 with which the cylindrical member 36 and springs 46 and 48 are engaged, a portable ramp 52 may be operatively associated with the rear end of the rack 10 and utilized when moving a vehicle onto or from the rack 10.

When a vehicle whose frame or body is to be straightened is moved up onto the rack 10, the vehicle is moved to a point with its center of gravity disposed forward of the legs 34 whereby the rack 10 will automatically swing from the inclined phantom line position thereof illustrated in FIG. 5 to the horizontal solid line position of FIG. 5. Thereafter, a portable stand 56 may be engaged with the rear corner of the outer I-beam rails 22 in order to brace the rack 10 against movement from the solid line position of FIG. 5 to the phantom line position of FIG. 5.

Figure 2:
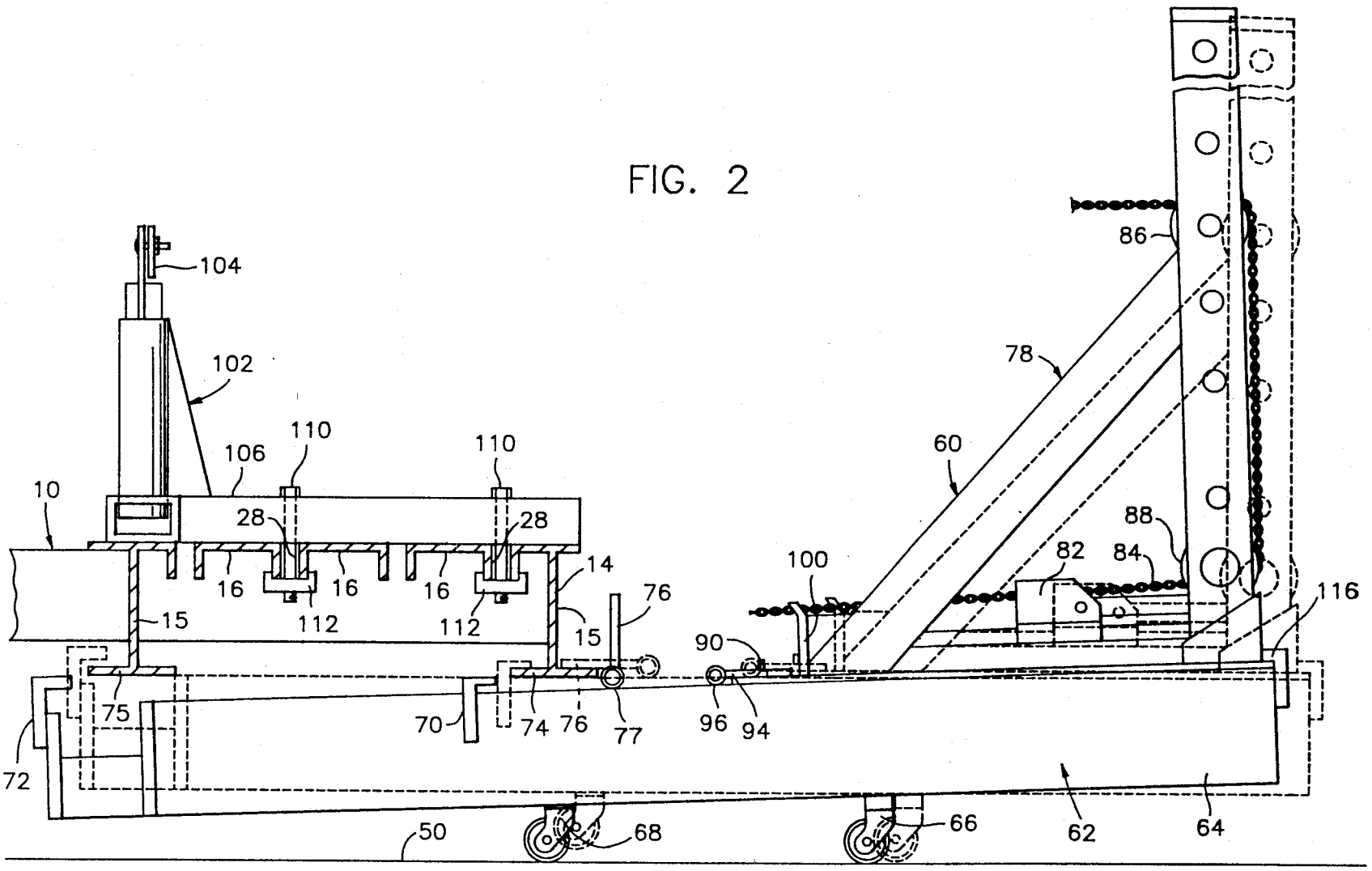
FIG. 2 is an enlarged fragmentary transverse vertical sectional view of one side of the rack illustrating a vehicle pinch weld area hold down clamp supported therefrom and a portable, wheeled pull tower operatively associated with one marginal portion of the rack.
Figure 3:
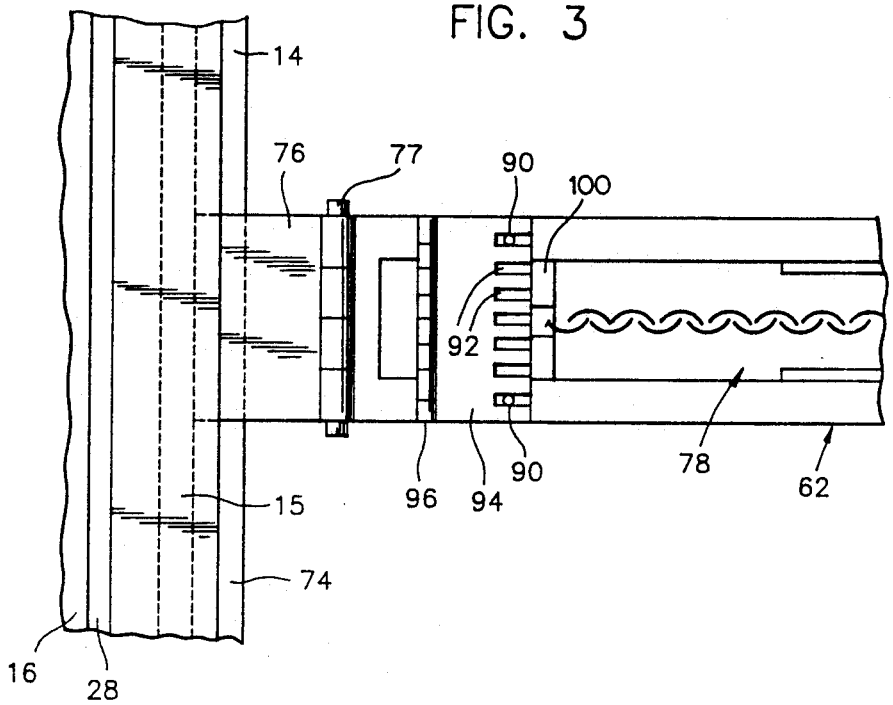
FIG. 3 is an enlarged fragmentary top plan view of the adjacent portions of the rack illustrated in FIG. 2.

Referring now more specifically to FIG. 2, there may be seen a portable pull tower referred to in general by the reference numeral 60. The pull tower includes a lower horizontal beam structure referred to in structure by the reference numeral 62 comprising a pair of side-by-side and interconnected beams 64 and each beam 64 includes outer and inner caster wheel assemblies 66 and 68. Also, the inner end of each pair of beams includes outer and inner inverted L-shaped hooks 70 and 72 supported therefrom and the beam structure 62, when the caster wheel assemblies 66 and 68 are disposed on the floor 50, is inclined such that the beam structure 62 may be moved inwardly under one of the treadways 14 beneath the I-beam rails 15 thereof to the position illustrated in solid lines in FIG. 2. Then, the outer end of the beam structure 62 is downwardly displaced so as to tilt the beam structure 62 to a horizontal position about the caster wheel assemblies 66 and the beam structure 62 is then pulled outwardly relative to the associated treadway 14 so as to engage the inverted hooks 70 and 72 over the inner flange portions 74 and 75 of the I-beam rails 15 (note the phantom line position of the pull tower 60 illustrated in FIG. 2). Thereafter, a hinge leaf type of latch 76 pivotally supported from the beam structure 62 as at 77 is swung from the raised vertical position illustrated in phantom lines in FIG. 2 to the lowered horizontal position illustrated in phantom lines in FIG. 2 so as to lock the pull tower 60 in position relative to the rack 10.

The pull tower 60 includes a tower structure referred to in general by the reference numeral 78 pivotally supported from the beam structure 62 for angular displacement about a vertical axis in a manner not shown but similar to that indicated as at 96 in my co-pending application U.S. Ser. No.: 07/760,011, filed Sep. 13, 1991. In addition, the pull tower 60 includes a ram actuated pull member 82 with which selected areas along a link chain 84 may be engaged and the link chain passes about upper and lower pulleys 86 and 88 journaled from the tower structure 78. The forward portion of the pivotally mounted tower structure 78 includes a pair of laterally spaced apart upwardly projecting pins 90 and the pins 90 are receivable in selected notches 92 formed in a second hinge leaf type of latch 94 pivotally supported from the beam structure 62 as at 96. Thus, the latch 94 may be used to releasably retain the tower structure 78 in adjusted angulated positions relative to the beam structure 62. Also, the forward portion of the tower structure 78 includes a notched upstanding anchor plate 100 with which selected longitudinally spaced portions of the link chain 84 may be engaged between intermittent pulls by the ram actuated pull member 82.

Figure 4:
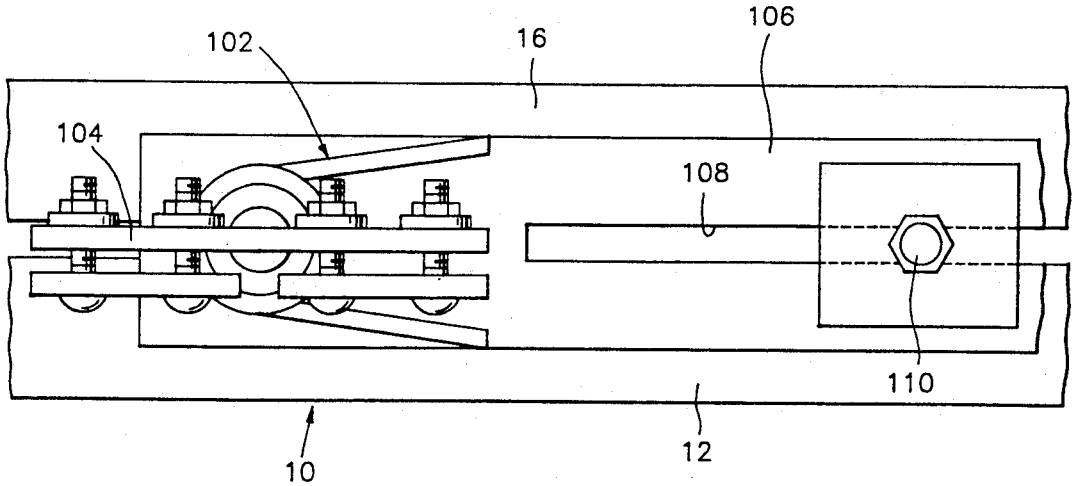
FIG. 4 is a fragmentary enlarged top plan view of one outside rail of the rack and the adjacent inner rail with a pinch weld assembly supported therefrom in an inoperative or retracted position.

With attention now invited to FIGS. 2 and 4, there will be seen an adjustable height pinch weld clamp supporting stand assembly referred to in general by the reference numeral 102. The stand assembly 102 adjustably supports a pinch weld area clamp 104 from its upper end and the lower end thereof is supported from one end of a tubular beam 106 longitudinally slotted as at 108. A pair of anchor bolts 110 are removably passed downwardly through the slot 108, downwardly through corresponding slots 28 and are threadedly engaged through cross heads 112 bridging the corresponding slots 28. When the bolts 110 are tightened and the tubular beam 106 is disposed transversely of the corresponding treadway 14, the pinch weld area clamps 104 may be utilized to support the pinch weld areas of a unibody construction vehicle therefrom.

When it is desired to remove a vehicle from the rack 10 or to move a vehicle up onto the rack 10, the outer bolt 110 illustrated in FIG. 2 is loosened and the inner bolt 110 is removed. Thereafter, the tubular beam 106 is pivoted to a position overlying and paralleling the outermost slot 28 (see FIG. 4) so that a vehicle may move along the corresponding treadway 14 inwardly of the stand assembly 102.

With attention again invited to FIGS. 2 and 4 of the drawings, one or more of the pins 90 is registered with and received within a slot 92 of the latch 94 as the tower structure 78 is angularly displaced relative to the beam structure 62 and secured in adjusted rotated position. This allows the chain 84 to be used in effecting angular pulls. Furthermore, the pulley 86 may be adjusted in height along the tower structure 78 and the outer end of the beam structure 62 includes an inverted L-shaped hook 116 which laps over the rear margin of the tower structure 78 in its various adjusted positions in order to resist inward tilting of the tower structure 78 relative to its pivot axis during a generally horizontal pull.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a generally horizontal support surface, a vehicle repair rack including an elongated generally horizontal platform having opposite first and second ends and defining side longitudinally extending treadway marginal portions for receiving and supporting a wheeled vehicle thereon, mounting means mounting said platform from and in elevated position relative to said support surface for oscillation of said platform relative to said support surface about a horizontal axis disposed transverse to the longitudinal mid-portion of said platform and for back and forth swinging of said platform between a first substantially horizontal position and a second inclined position with said first and second ends of said platform lowered and abutted against and raised relative to said support surface, spring means operatively associated with said platform and support surface yieldingly biasing said platform toward said second inclined position, said support surface and platform including first coacting means defining a positive limit of movement of said platform from said second position toward said first horizontal position and second coacting means defining a positive limit of movement of said platform from said first position toward said second inclined position, said platform when in said second inclined position, being disposed with said first end abutting said support surface for movement of a wheeled vehicle along said surface, toward and up onto said first end and thereafter upwardly along said platform toward the second end until passing an "over center" position relative to said axis such that the over center loading of said platform by said vehicle will swing said platform from said second position to said first position.

2. The combination of claim 1 wherein said mounting means includes rocker means dependingly supported from said platform and supported from said surface.

3. In combination with a vehicle support platform supported in elevated position from a support surface and upon which a vehicle may be removably supported for performing body and frame straightening operations thereon, said platform including at least one marginal portion, a pull tower including a horizontally elongated base, said base including first and second end portions and first and second support wheel means supported from said first and second end portions, respectively, and supporting said base for rolling movement over said surface, said first end portion of said base being longitudinally displaceable inwardly beneath said one marginal portion to a predetermined position relative thereto, said base being rockable about said second support wheel means to elevate said first end portion and said first wheel means, slightly, relative to said surface, said first end portion and said one marginal portion including coacting lock means operative to releasably lock said first end portion to said one marginal portion against shifting relative thereto upon slight outward shifting of said base from said predetermined position when said first end portion is elevated slightly relative to said surface.

4. The combination of claim 3 wherein said other end portion of said base pivotally supports a tower structure therefrom for adjustable angular displacement relative to said base about an axis.

5. The combination of claim 4 wherein said tower structure and base include coacting latch means operative to releasably latch said tower structure in adjusted angularly displaced positions relative to said base.

6. In combination with a vehicle support platform supported in elevated position from a support surface and upon which a vehicle may be removably supported for performing body and frame straightening operations thereon, said platform including at least one marginal portion, said one marginal portion including at least three laterally spaced apart rails extending longitudinally thereof and defining slots between each pair of adjacent rails, an elongated tubular base disposed transverse to and supported over and from said rails, said tubular base including vehicle chassis support structure supported from one end portion thereof for supporting a selected vehicle chassis portion therefrom in elevated position relative to said one marginal portion, the other end portion of said tubular base and said one end portion thereof including anchor structure supported therefrom each projecting downwardly through a corresponding slot and releasably anchored relative to undersurface portions of adjacent rails, at least the anchor structure supported from said one end portion being removable upwardly through the corresponding slot and said tubular base being horizontally swingable over said one marginal portion about the other anchor structure to a position with said tubular base paralleling and overlying the slot through which said other anchor structure extends.

7. In combination with a generally horizontal support surface, a vehicle repair rack including an elongated generally horizontal platform having opposite first and second ends and defining side longitudinally extending treadway marginal portions for receiving and supporting a wheeled vehicle thereon, mounting means mounting said platform from and in elevated position relative to said support surface for oscillation of said platform relative to said support surface about a horizontal axis disposed transverse to the longitudinal mid-portion of said platform and for back and forth swinging of said platform between a first substantially horizontal position and a second inclined position with said first and second ends of said platform lowered and raised relative to said support surface, said platform being yieldingly biased toward said second position, said support surface and platform including first coacting means defining a positive limit of movement of said platform from said second position toward said first position and second coacting means defining a positive limit of movement of said platform from said fist position toward said second position, said platform when in said second inclined position, being disposed relative to said support surface for movement of a wheeled vehicle along said surface, toward and up onto said first end and thereafter upwardly along said platform toward the second end until passing an "over center" position relative to said axis such that the over center loading of said platform by said vehicle will swing said platform from said second position to said first position, a pull tower having a horizontal base, said base including first and second end portions and first and second support wheel means supported from said first and second end portions, respectively, and supporting said base for rolling movement over said surface, said first end portion of said base being longitudinally displaceable inwardly beneath one of said marginal portions to a predetermined position relative thereto, said base being rockable about said second support wheel means to elevate said first end portion and said first wheel means, slightly, relative to said surface and said first end portion and said one marginal portion including coacting lock means operative releasably lock said first end portion to said one marginal portion against shifting relative thereto upon slight outward shifting of said base from said predetermined position when said first end portion is elevated slightly relative to said surface.

8. The combination of claim 7 wherein said one marginal portion includes at least three laterally spaced apart rails extending longitudinally thereof and defining slots between each pair of adjacent rails, an elongated tubular base disposed transverse to and supported over and from said rails, said tubular base including vehicle chassis support structure supported from one end portion thereof for supporting a selected vehicle chassis portion therefrom in elevated position relative to said one marginal portion, the other end portion of said tubular base and said one end portion thereof including anchor structure supported therefrom each projecting downwardly through a corresponding slot and releasably anchored relative to undersurface portions of adjacent rails, at least the anchor structure supported from said one end portion being removably upwardly through the corresponding slot and said tubular base being horizontally swingable over said one marginal portion about the other anchor structure to a position with said tubular base paralleling and overlying the slot through which said other anchor structure extends.

* * * * *